United States Patent [19]

Gobush et al.

[11] 4,001,971

[45] Jan. 11, 1977

[54] UNIT WINDOW REGULATOR ASSEMBLY

[75] Inventors: Michael Gobush, Northville; Richard Freedland, Southfield, both of Mich.

[73] Assignee: Freedland Industries Corporation, Dearborn, Mich.

[22] Filed: Sept. 2, 1975

[21] Appl. No.: 609,621

[52] U.S. Cl. ..... 49/352; 49/227

[51] Int. Cl.[2] ..... E05F 11/48

[58] Field of Search ..... 49/352, 227

[56] References Cited

UNITED STATES PATENTS

| | | | |
|---|---|---|---|
| 1,535,989 | 4/1925 | Clas | 49/352 |

FOREIGN PATENTS OR APPLICATIONS

| | | | |
|---|---|---|---|
| 554,954 | 3/1923 | France | 49/352 |
| 581,285 | 7/1933 | Germany | 49/352 |
| 631,130 | 10/1949 | United Kingdom | 49/352 |

*Primary Examiner*—Kenneth Downey
*Attorney, Agent, or Firm*—Cullen, Settle, Sloman & Cantor

[57] ABSTRACT

A unit window regulator assembly is adapted for use in conjunction with a vehicle door or body having a framework and an upright opening defined by inner and outer walls. The regulator comprises a pair of spaced transverse support brackets securable to said framework and supportably mounting an upwardly opening C frame in said opening for longitudinal and transverse adjustments within said opening. A pair of spaced elevator channels receive and supportably mount the lower edge of an upright window secured thereto. A pair of parallel spaced formed guide rods at their lower ends are anchored to said brackets and at their upper ends are secured to said outer wall. First lateral apertured flanges on said channels receive and are guidably mounted on said rods for a predetermined vertical and translation movement within the window opening. Second lateral flanges upon the opposite side of said channels provide a means of connecting the ends of a pair of elevator cables which are respectively secured to said lateral flanges, and are wound in opposite directions around a rotatable capstan mounted on the inner wall. A series of coplaner longitudinally spaced upper and lower pulleys are supported upon said C frame over which the respective cables extend in such fashion that selective rotation of said capstan respectively raises and lowers said window in a path defined by said guide rods.

4 Claims, 6 Drawing Figures

FIG. 1
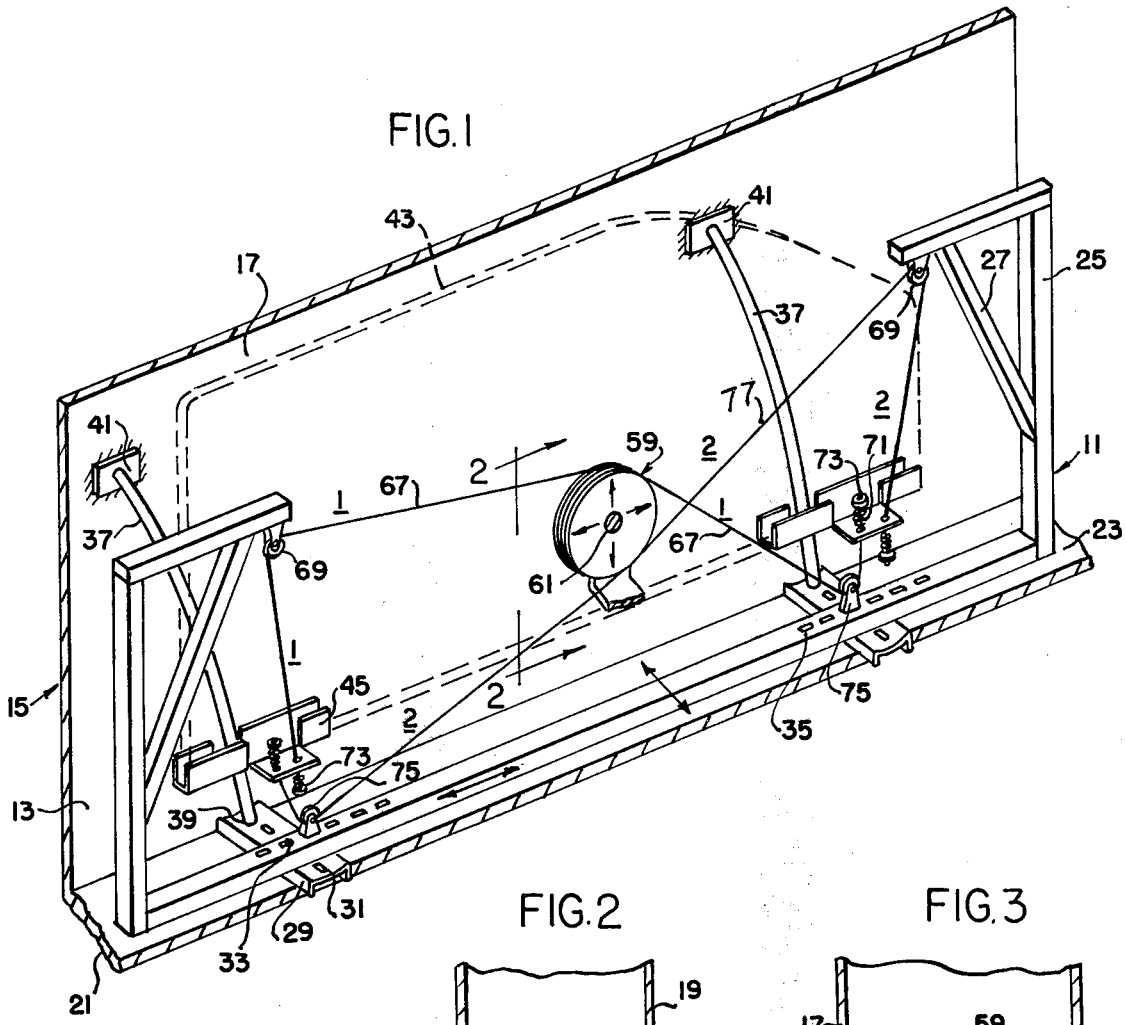
FIG. 2
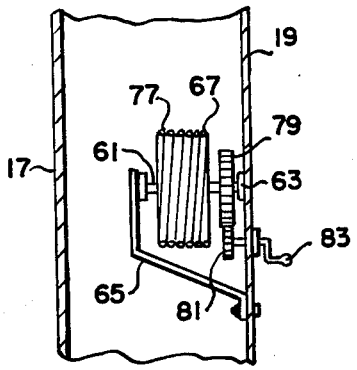
FIG. 3
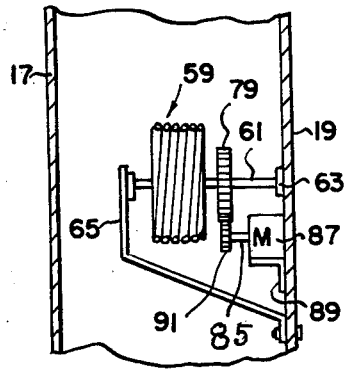
FIG. 6
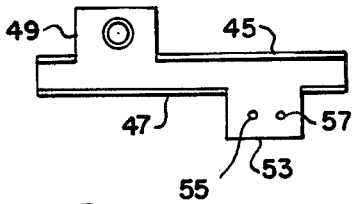
FIG. 5
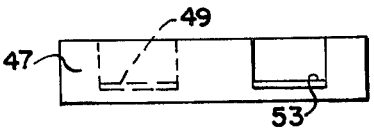
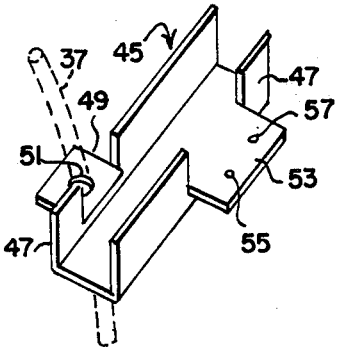
FIG. 4

UNIT WINDOW REGULATOR ASSEMBLY

BACKGROUND OF THE INVENTION

Heretofore, various types of window regulators have been provided for window openings with various types of mechanical means provided for effecting raising and lowering of a window within said opening and guidably positioned for movements therein. More recently, in vehicle constructions and due to the shape of the door or other body opening, the normal reciprocal vertical movements of the window are modified by relative longitudinal or translation movements requiring an improved type of window regulator.

BRIEF DESCRIPTION OF THE INVENTION

It is an object of the present invention to provide a unit window regulator assembly which is so constructed with its frame support brackets elevator channels and pulleys as to permit insertion of the unit assembly down into a window opening for adjustable anchoring therein.

It is a further object to provide in conjunction with said unit window regulator window support elevator channels which provide for guided vertical and translation movements of the window and at the same time, provide means for anchoring sets of control cables driven by a common capstand for exerting uniform lifting and lowering pressure upon the window.

These and other objects will be seen from the following specification and claims in conjunction with the appended drawing.

THE DRAWING

FIG. 1 is a fragmentary perspective view of the present unit window regulator assembly as projected down into an opening within a door or body of a vehicle which has a framework and inner and outer walls defining such window opening, the inner wall being omitted for clarity.

FIG. 2 is a fragmentary section taken in the direction of arrows 2—2 of FIG. 1 and including the inner wall of the vehicle body or door, and illustration the manual control for the window regulator.

FIG. 3 is a similar view illustrating a power-operated window regulator.

FIG. 4 is a perspective view of a window supporting elevator channel with guide and cable-anchoring flanges.

FIG. 5 is a side elevational view thereof.

FIG. 6 is a plan view thereof.

It will be understood that the above drawing illustrates merely a preferred embodiment of the invention, and that other embodiments are contemplated within the scope of the claims hereafter set forth.

DETAILED DESCRIPTION OF THE INVENTION

The present unit window regulator assembly is generally designated at 11, FIG. 1, as nested within window opening 13 within a door or vehicle body 15 defined by outer and inner walls 17 and 19, respectively, as shown in FIGS. 2 and 3. The door or body includes framework 21 including the horizontally disposed support plate 23. The present unit window regulator assembly includes the upwardly opening C frame 25 with reinforcements 27 and mounted on brackets 29. A pair of said brackets 29 with longitudinally spaced slots 31 is anchored to framework plate 23 with suitable fasteners.

The base portion of said C frame includes a series of longitudinally spaced slots 35 adapted to receive fasteners 33 to permit longitudinal and transverse adjustment of the C frame with respect to the brackets 29 within the window opening.

A pair of arcuate, or irregularly shaped formed window guide rods 37 are anchored at their lower ends at 39 to the respective brackets, and terminate at their upper ends in plates 41 and suitably secured to the interior of the outer wall 17 as by welding or the like.

The pre-formed window 43 in an upright position spans a pair of horizontally disposed elongated elevator channels 45 and is projected down into and secured thereto between the channel side walls 47.

Each elevator channel has a right angular struck out first flange 49 apertured at 51 to receive and to be slidably and guidably mounted upon the corresponding window guide rod 37 for controlled translation upward and downward movements.

Each of the elevator channels have upon its opposite side a second struck out right angularly related flange 53 having a pair of apertures 55 and 57 which provide the means of receiving and yieldably anchoring the present control cables 67 and 77.

Separate from the window regulator C frame, there is provided rotatable capstan 59 or drum secured upon shaft 61 as in FIG. 3. Said shaft at one end is journalled upon the inner wall 19 of the door or body as at 63, and at its opposite end is journalled upon the bracket 65, fragmentarily shown which is secured to said inner wall. Said capstan has a series of spiral grooves adapted to supportably receive and drivingly engage the respective cables.

Arranged within a common upright plane and mounted upon said C frame are a pair of longitudinally spaced upper pulleys 69 and therebelow upon the base of said frame a pair of longitudinally spaced lower pulleys 75.

Cable 67 also referred to as cable No. 1 at its free end extends through aperture 57 of one elevator channel, FIG. 4 and FIG. 1, and is yieldably anchored to flange 53 by combination spring 71 and washer 73. Said cable extends up and over upper pulley 69, is wound around said capstan 59 in one direction, extends around one longitudinally spaced lower pulley 75, and up through aperture 55 of the second flange 53 of the other elevator channel. The free end of said cable is likewise yieldably anchored to said second flange by a suitable spring 71 and anchoring washer 73.

The other cable 77, referred to as cable No. 2, at one free end, extends through aperture 57 of the second flange 53 of the other elevator channel and is yieldably anchored thereto by a corresponding spring and washer assembly 71,73. Cable No. 2 extends upwardly through said aperture 57 around the other upper pulley 69, is wound around the capstan 59 in the opposite direction, and extends downwardly and around the other lower pulley 75 and upwardly through the corresponding aperture 55 of the second flange of the first elevator channel and is yieldably secured thereto in the same fashion employing a spring and washer.

By this construction, manual or power rotation of the capstan 59 or drum or pulley in one direction such as clockwise, causes the window 43 to be elevated and at the same time, translated longitudinally as determined by the shape and arrangement of the respective parallel guide rods 37. Rotation of the capstand 59 in the opposite direction will effect a corresponding but downward movement of the window 43.

Referring to FIG. 2, showing a form of manual operation of the window regulator, pinion 81 journalled upon the inner wall 19 on handle 83 is in mesh with gear 79 secured to the corresponding shaft 61.

Accordingly, rotation of the handle 83 controls raising and lowering of the window. In FIG. 3, there is fragmentarily shown a means for effecting powered raising and lowering of said window. For this purpose, motor 87 is anchored upon a suitable bracket 89 upon door inner wall 19 and includes output shaft 85 mounting pinion 91 in mesh with a corresponding gear 79 upon drum shaft 61. The motor 85 is connected into the vehicle electrical system in such a manner that movements of a switch upon the inner wall 19 effects operation of the motor 87 and its shaft 85 in opposite directions for power raising and lowering said window.

In the present illustrative embodiment, the present unit window regulator incorporates an upwardly opening C frame of a tubular construction and with tubular reinforcements. The base portion of the C frame is adapted for longitudinal as well as transverse adjustment upon its supporting brackets 29 and for securing to the framework 21,23 in such a manner as to accomodate the complete unit window regulator assembly and the associated elevator channels 45. These mount and support and control vertical and translatory movements of window 43 over and with respect to the stationary guide rods 37.

Having described our invention, reference should now be had to the following claims.

We claim:

1. For use in conjunction with a vehicle door or body having a framework and an upright opening defined by inner and outer walls;

a unit window regulator assembly nested within said opening comprising a pair of longitudinally spaced transverse support brackets secured to said framework;

an upright upwardly opening C frame in said opening spanning and supported upon and adjustably secured to said brackets for longitudinal and transverse adjustments thereon;

a pair of horizontally disposed longitudinally spaced elevator channels;

an upright window spanning, supported upon and secured to said channels;

a pair of parallel spaced arcuate guide rods at their lower ends secured to said brackets and at their upper ends secured to said outer wall;

first lateral apertured flanges on one side of said channels receiving and guidably mounted on said rods for predetermined vertical and longitudinal translation movements;

second lateral flanges upon the other side of said channels;

a rotatable capstan journalled on said inner wall within said opening;

longitudinally spaced coplaner upper and lower pulleys on upper and lower portions of said C frame;

a first cable at one end connected to the second lateral flange of one channel, extending through an upper pulley and a longitudinally spaced lower pulley, wound in one direction around said capstan, and at its other end secured to the second lateral flange of the other channel;

and a second cable at one end connected to the second lateral flange of said other channel, extending through an upper pulley and a longitudinally spaced lower pulley, wound in the opposite direction around said capstan, and at its other end secured to the second lateral flange of said one channel, whereby rotation of the capstan in one direction elevates and longitudinally translates the window for movement along said guide rods, and in the other direction, lowers said window.

2. In the unit window regulator of claim 1, said second lateral channel flange including a pair of cable apertures; the respective free ends of said cables extending through said apertures; a washer on the free ends of said cables; and a coiled spring on each cable interposed between said washer and said second lateral flange defining a yielding connection between said cable ends and elevator channels.

3. In the unit window regulator of claim 1, said brackets having a series of longitudinally spaced fastener receiving slots; the base of said C frame having a series of longitudinally spaced fastener receiving slots; and fasteners selectively extending through said slots, and support brackets whereby said C frame may be adjusted longitudinally and transversely within said window opening.

4. For use in conjunction with a vehicle door or body having a framework and an upright opening defined by inner and outer walls;

a unit window regulator assembly nested within said opening comprising a pair of longitudinally spaced transverse support brackets secured to said framework;

an upright upwardly opening C frame in said opening spanning and supported upon and adjustably secured to said brackets for longitudinal and transverse adjustments thereon;

a pair of horizontally disposed longitudinally spaced elevator channels;

an upright window spanning, supported upon and secured to said channels;

a pair of parallel spaced formed guide rods at their lower ends secured to said brackets and at their upper ends secured to said outer wall;

first lateral apertured flanges on one side of said channels receiving and guidably mounted on said rods for predetermined vertical and longitudinal translation movements;

second lateral flanges upon the other side of said channels;

a rotatable capstan journalled on said inner wall within said opening;

a series of coplaner upper and lower pulleys on upper and lower portions of said C frame;

first and second cables oppositely wound around said capstan, respectively extending around a pair of longitudinally spaced upper and lower pulleys, with their respective free ends anchored to the second lateral flanges of said elevator channels, so that selective rotation of said capstan respectively raises and lowers said window in a path defined by said guide rods.

* * * * *